United States Patent [19]

Tomasula

[11] Patent Number: 4,643,247

[45] Date of Patent: Feb. 17, 1987

[54] TUBE EXTRACTING AND REPLACING APPARATUS

[76] Inventor: Ronald L. Tomasula, 358 Iroquoid Pl., Beaver, Pa. 15009

[21] Appl. No.: 681,674

[22] Filed: Dec. 14, 1984

[51] Int. Cl.[4] ..... F28F 7/00

[52] U.S. Cl. ..... 165/76; 29/726; 29/157.4

[58] Field of Search ..... 165/76; 29/726, 157.3 R, 29/157.3 C

[56] References Cited

U.S. PATENT DOCUMENTS

| | | | |
|---|---|---|---|
| 3,120,700 | 2/1964 | Chuplis, Jr. | 29/726 |
| 3,125,800 | 3/1964 | Klima | 29/726 |
| 3,837,062 | 9/1974 | Ohmstede | 29/726 |
| 4,104,790 | 8/1978 | Hindrichs | 29/726 |
| 4,547,963 | 10/1985 | Ohmstede | 29/726 |

*Primary Examiner*—Albert W. Davis, Jr.
*Assistant Examiner*—Peggy A. Neils
*Attorney, Agent, or Firm*—William J. Ruano

[57] ABSTRACT

An extracting and replacing assembly for a heat exchanger or similar device. It comprises, on each end of the tubing of the heat exchanger, a vertical track mounted on each side of the heat exchanger, together with a vertical carriage movable on the track. A horizontal positioning track is carried by the vertical carriages, along which a horizontal positioning carriage is movable so as to be selectively positioned on the ends of any of the tubes of the heat exchanger. Such horizontal positioning carriage supports a tubing coil straightener and coil mount, a tube extraction system, a drive mechanism for severed tubes, a portable cutter for removing the sealed weld, a tube expansion roller, and/or automatic seal welder. Thus, tubing can be selectively removed and replaced in a minimum amount of time and at a minimum of expense in the confined and restrictive atmosphere that exists in may power generating plants.

1 Claim, 7 Drawing Figures

TUBE EXTRACTING AND REPLACING APPARATUS

This invention relates to a tube extracting and replacing apparatus for heat exchangers and the like.

After use, tubing of heat exchangers or the like, require repair, straightening and removal as well as substitution of new tubing. An outstanding disadvantage of conventional methods is that no easy quick assembly has been devised for replacing or repairing tubing.

An object of the present invention is to provide a novel assembly for the purpose of conditioning, repairing, or replacing tubing of heat at exchangers and the like.

Other objects and advantages of the invention will become more apparent from a study of the drawings wherein.

Figure 1:
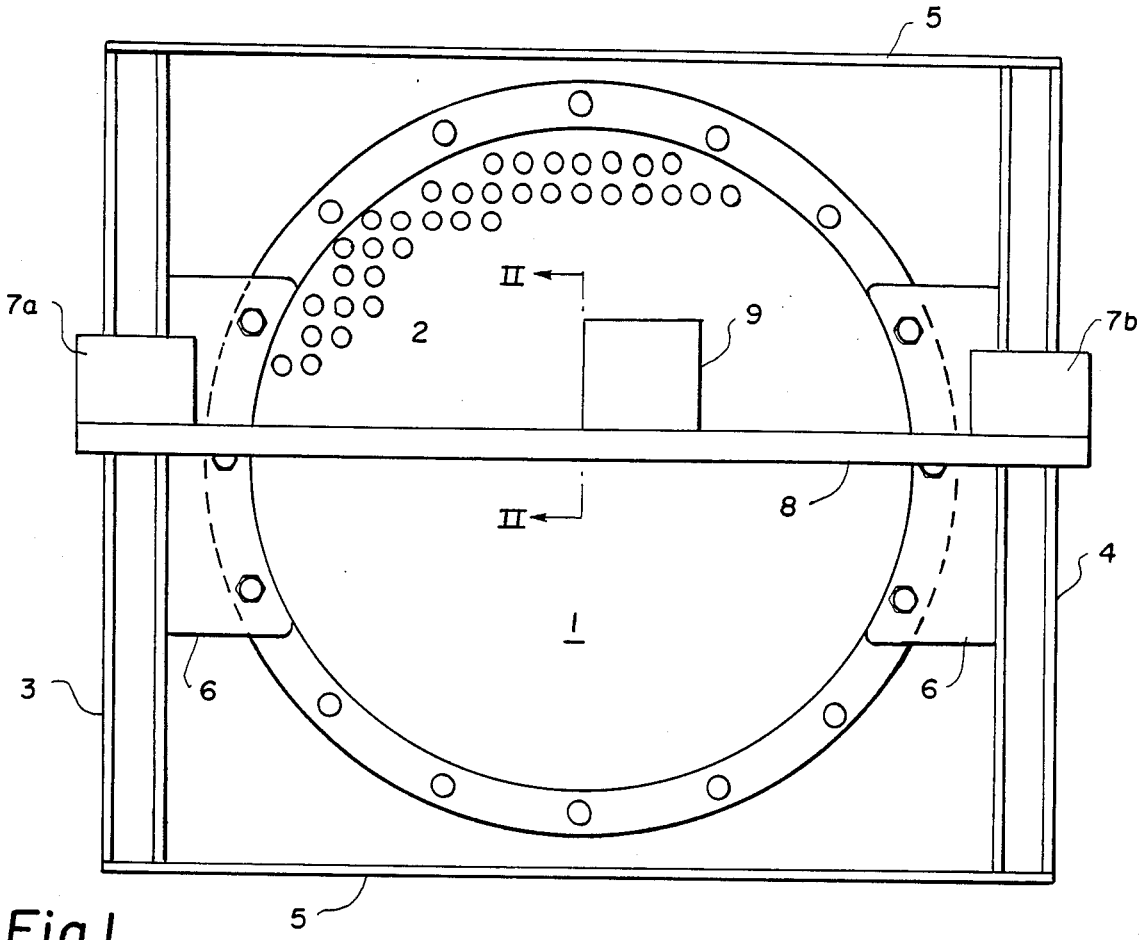
FIG. 1 is an elevational view of one end of the tubing of a heat exchanger or similar device.
Figure 2:
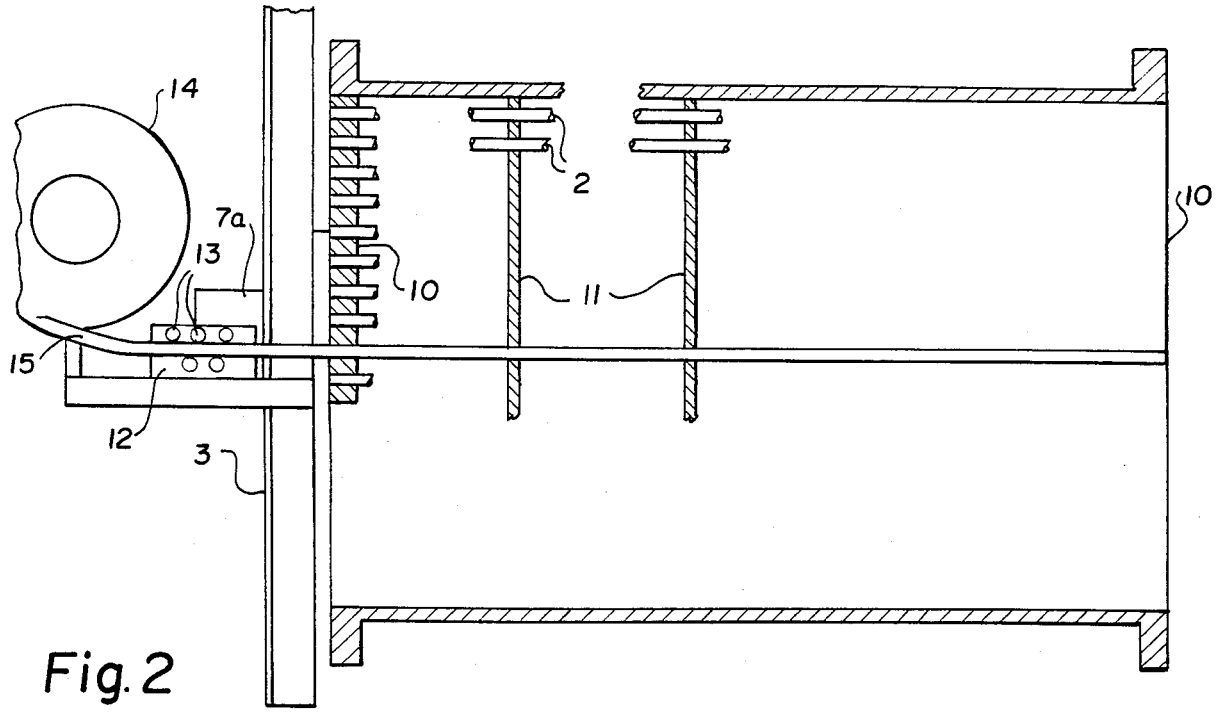
FIG. 2 is a vertical cross-sectional view taken along line 2—2 of FIG. 1.

Referring more particularly to FIGS. 1 and 2 of the drawings, numeral 1 generally denotes a tubing bundle for a heat exchanger or similar apparatus comprising a plurality of tubes 2. On the sides of the heat exchanger, are mounted vertical positioning tracks 3 and 4 which are interconnected by squaring plates 5, 5. The tracks are secured by means of mounting plates 6, 6 to the rim of the heat exchanger. Vertical carriages 7*a* and 7*b* ride on the tracks 3 and 4 respectively, and have connected thereto, a horizontal positioning track 8 on which is supported a horizontal positioning carriage 9 for carrying the tubing coil and straightener as well as other apparatus. As shown in FIG. 2, tube sheets 10, 10 are provided on the respective ends and spaced support plates 11 are supported therebetween for carrying the tubing or tubes 2.

Mounted on carriage 7*a* is a tube straightener 12, pressure rollers 13 and a tubing coil and mounting spool 14, carrying new tubing 15.

Figure 3:
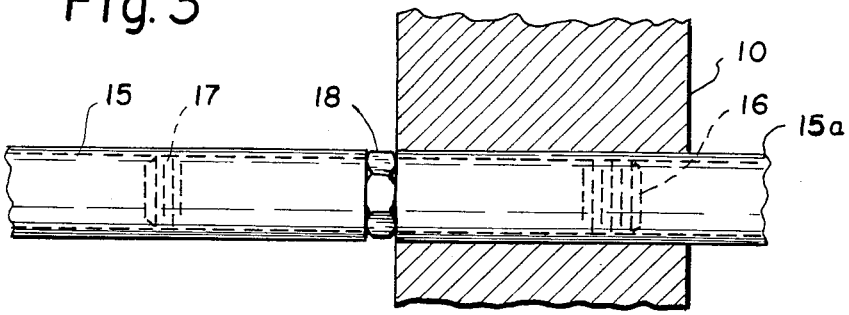
FIG. 3 is an enlarged view showing the joints between old and existing tubing, illustrated in FIG. 3 on the left tube sheet.

FIG. 3 shows new tubing 15 being connected to existing tubing 15*a* by self-tapping right hand thread 16 and left hand thread 17 by rotation of a nut 18 rigidly secured thereto.

Figure 4:
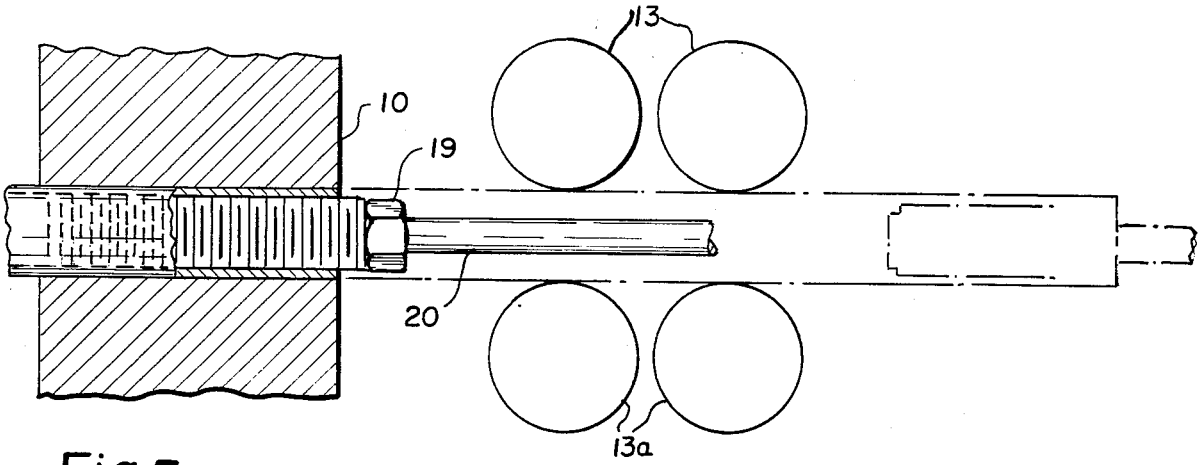
FIG. 4 shows an enlarged fragmentary view of the joints between tubing as it exits through the right hand end tube sheet.

FIG. 4 shows tube sheet 10 at the right or exit side of the bundle comprising a hollow threaded collar 19 surrounding an extraction rod 20 providing a puller for pulling the tubing through the tube sheet. Pressure rollers 13 are provided and knurled drives 13*a* which are engaged after removing the core puller.

Figure 5:
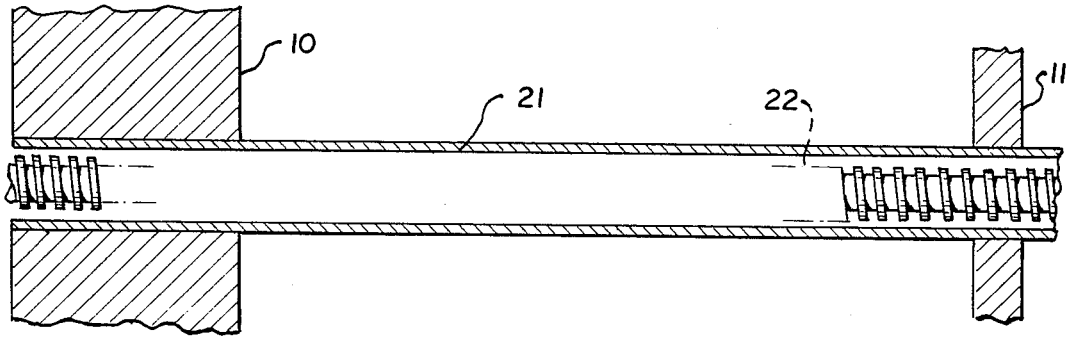
FIG. 5 shows an enlarged view of how the extraction rod is in place and pulls a damaged tube out from the end of the tube sheet.

FIG. 5 shows a threaded rod extending through the full length of tube for pulling a damaged tube out from the end using the puller as shown in FIG. 4 while leaving the rod in place. A threaded joint 22 is provided. If the tube is severed, the extraction device is on both ends of the tube.

Figure 6:
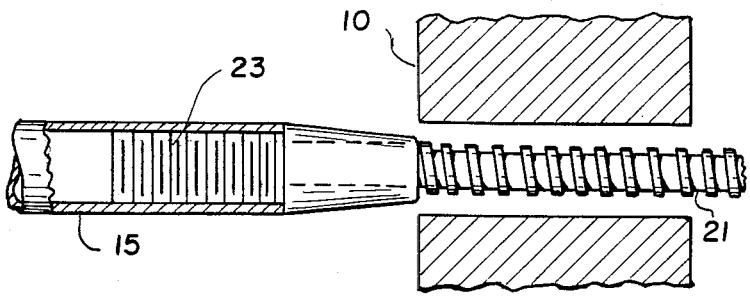
FIG. 6 and FIG. 7 show how a threaded rod is moved through the near end (left) and far end (right) of the tube sheets shown in FIG. 2.
Figure 7:
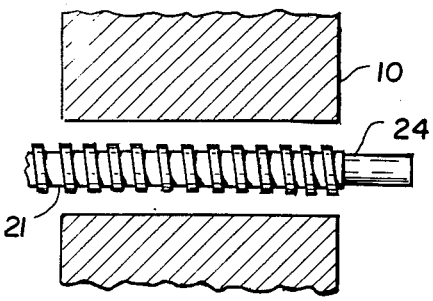

FIGS. 6 and 7 show how a new tube 15 is connected by a self-tapping thread 13 to a sleeve through which there projects a rod 21 terminating beyond the far end tube sheet end, a square pin 24 for connection to a drive motor (not shown).

The operational sequence is as follows:

1. Mount the positioning track and carriage on both ends of the tubes.
2. Mount the portable cutter (not shown) on both carriages.
3. Cut the seal welds off the tube ends of the tubes to be replaced.
4. Remove portable cutters.

Note: If severed tubes, proceed to Step 18.

5. Mount the tubing coil straightner and coil mount apparatus on one carriage while mounting the tube extraction system on the carriage on the opposite end of the heat exchanger.
6. Align the carriages at each end to the same tube location.
7. Connect the new tube (from the coil) to the existing tube as shown in FIG. 3.
8. Connect the extraction rod as shown in FIG. 4.
9. Activate the extraction system and pull the existing tube out approximately thirty (30) inches, and remove the extraction rod collar. (This action will have pulled the new tubing through the tube straightener and into the heat exchanger at the opposite end of the heat exchanger).
10. At this point, engage the extraction drive mechanism and pull the new tube through as the old tube is being extracted. If the rollers should bind, the exiting tube can be cut with tube cutters and the extraction rod re-engaged.
11. After pulling the new tube material all the way through the heat exchanger, disengage the extraction device and cut both ends of the new tubing loose.
12. Go to the next tube and return to Step 6, until all the tubes are replaced.
13. Remove the extraction system and tube straightener from each end.
14. Mount the tube and expansion system on the carriage at each end of the heat exchanger.
15. Next, roll the tube ends at both tubesheets tight against the sides of the hole in the tubesheet. Then trim away all excess tubing material until flush with the tubesheet (do all tube ends).
16. Remove expansion devices and install seal welders on both carriages.
17. Seal weld each tube to the tubesheet. After seal welding each tube, remove all equipment and prepare to leave the job site.
18. If the tube is severed, insert the segmented threaded rod as shown in FIG. 5 in each severed tube.
19. Mount a tube extraction system on the carriages at each end of the heat exchanger and connect each end of the severed tube as shown in FIG. 4. Remove all the severed tubes from each end of the heat exchanger.
20. Remove the tube extraction systems from each carriage.
21. Mount the tubing coil straightener and coil mount on one end of the heat exchanger and mount the drive mechanism for the threaded rod on the carriage at the opposite end of the heat exchanger.
22. Connect the new tubing material (from the coil) to the tube guidance nut as shown in FIG. 6.

23. Simultaneously align the drive mechanism with the threaded rod to which the tube guidance nut has been affixed.

24. Engage the drive mechanism in order to turn the threaded rod which in turn will pull the guide nut and the attached tube through the heat exchanger.

25. After traversing the heat exchanger, cut both ends of the tubing loose, remove the guide nut, and proceed to the next severed tube location and repeat the sequence until all the severed tubes have been replaced.

26. Remove the drive mechanisms and tube straightener from the respective carriages.

27. Go to Step 14 and complete Steps 14, 15, 16 and 17.

Although this concept is being presented in a single tube context, the equipment will be designed and fabricated to perform multiple tube extraction/replacement at a simultaneous rate; as well as, perform applicable welding functions on same.

Thus it will be seen that I have provided an efficient tube extracting and replacing apparatus for the tube exchangers and similar apparatus for effectively and quickly replacing and straightening tubes in a minimum amount of time thereby considerably reducing "down time" as well as costs.

While I have illustrated and described a single specific embodiment of my invention, it will be understood that this is by way of illustration only and that various changes and modifications may be contemplated in my invention within the scope of the following claims.

I claim:

1. In a heat exchanger comprising a bundle of tubes, enclosed by a housing; the improvement comprising positioning means located at each end of said bundle of tubes, each positioning means comprising a pair of vertical carriages fastened to diametrically opposite portions of said housing, a horizontal positioning track rigidly connected to each of said pairs of vertical carriages, a coil of new tubing mounted on one of said horizontal positioning carriages, extracting means mounted on the other of said horizontal positioning carriages for extracting individual replaced tubes, a tube straightener mounted in association with said coil of new tubing for straightening the new tubing as it is being inserted in the tubing bundle for replacing a defective tube in said bundle, and a tube puller mounted on said other of said horizontal positioning carriages opposite said tubing coil mount for extracting defective tubes to be replaced and guide nut and a threaded rod inside of and extending the full length of said tubes to be replaced, which rod will pull the guide nut and attached tube through the heat exchanger.

* * * * *